US007032796B1

(12) United States Patent
Lin

(10) Patent No.: US 7,032,796 B1
(45) Date of Patent: Apr. 25, 2006

(54) FASTENING DEVICE FOR SECURING TOP PLATE ON NOSE OF STAPLERS

(75) Inventor: Hong-Liang Lin, Ta-Li (TW)

(73) Assignee: Apach Industrial Co., Ltd., Taichung Hsien (TW)

( * ) Notice: Subject to any disclaimer, the term of this patent is extended or adjusted under 35 U.S.C. 154(b) by 0 days.

(21) Appl. No.: 10/986,121

(22) Filed: Nov. 12, 2004

(51) Int. Cl.
*B25C 1/04* (2006.01)

(52) U.S. Cl. ..... 227/123; 227/127

(58) Field of Classification Search ..... 227/123, 227/120, 127, 128
See application file for complete search history.

(56) References Cited

U.S. PATENT DOCUMENTS 4,436,236 A * 3/1984 Jobe ..... 227/123
4,641,772 A * 2/1987 Skuthan ..... 227/123
5,642,849 A * 7/1997 Chen ..... 227/123
6,076,722 A * 6/2000 Huang ..... 227/123
6,325,268 B1 * 12/2001 Liang ..... 227/123
6,598,776 B1 * 7/2003 Adachi et al. ..... 227/123
6,651,862 B1 * 11/2003 Driscoll et al. ..... 227/123
6,763,989 B1 * 7/2004 Wang ..... 227/123
6,786,380 B1 * 9/2004 Driscoll et al. ..... 227/127

* cited by examiner

*Primary Examiner*—Scott A. Smith
(74) *Attorney, Agent, or Firm*—Rosenberg, Klein & Lee

(57) ABSTRACT

A stapler nose includes a passage defined therein and a plurality of stops extend from two sides of a face of the nose. A top plate is mounted on the face of the nose has positioning blocks which are engaged with the stops. Two first lugs extend from a face of two sides of the top plate. Two hooks are connected to one pair of the stops and each hook has an engaging recess. A fastening device includes a pivotable member which includes two second lugs and each second lug has a notch. The two second lugs are pivotably connected between the two first lugs. An enclosed loop has a first straight section for being engaged with the notches in the two second lugs and a rear straight section for being engaged with the first engaging recesses of the hooks.

8 Claims, 4 Drawing Sheets

FASTENING DEVICE FOR SECURING TOP PLATE ON NOSE OF STAPLERS

FIELD OF THE INVENTION

The present invention relates to a fastening device using an enclosed loop to secure the top plate to the nose of staplers.

BACKGROUND OF THE INVENTION

A conventional stapler generally includes a nose connected to a front end of the barrel of the stapler and a handle is connected to the barrel so as to be connected to a hose through which pressurized air introduced to eject nails or staples from the nose. A top plate is secured to the nose so as to define a passage for guiding nails or staples. In order to easily remove deformed nails or staples stock in the passage, the top plate is connected to the nose by screws. However, it requires screw drivers to unscrewed the screws when removing the top plate from the nose. This is not convenient for the users who cannot find a screw driver to unscrew the screws. Some manufacturers use a fastening device including a U-shaped member for hooking the top plate in position on the nose. Nevertheless, the U-shaped member tends to be deformed because of high stress concentration at bending portions. Once the U-shaped member is deformed, the gap between the top plate and the nose becomes wider and this could lead the nails or staples to undesired directions.

The present invention intends to provide a fastening device that uses an enclosed loop having two curved sections for providing proper flexibility so as to reduce any potential deformation of the loop.

SUMMARY OF THE INVENTION

The present invention relates to a assembly of a stapler nose and a top plate, wherein the nose includes a passage defined therein and two hooks extend from two sides of a face of the nose and each hook has an engaging recess. The top plate has two first lugs extending from a face of two sides thereof and is mounted on the face of the nose. A fastening device includes a pivotable member which includes two second lugs and each second lug has a notch. The two second lugs are pivotably connected between the two first lugs. An enclosed loop has a first straight section for being engaged with the notches in the two second lugs and a rear straight section for being engaged with the first engaging recesses 140 of the hooks.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
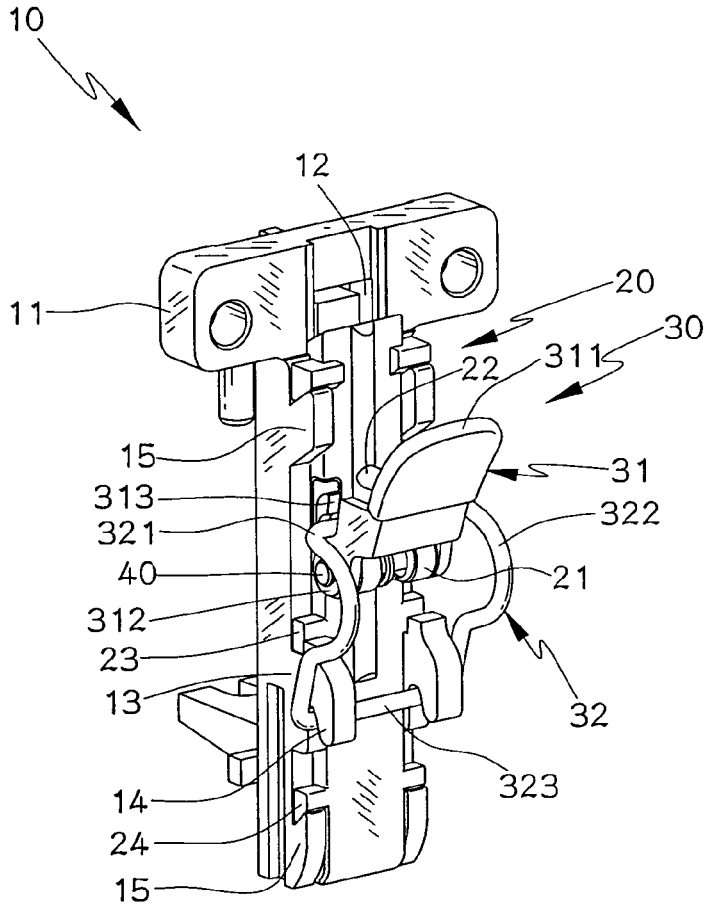
FIG. 1 is a perspective view to show the assembly of the nose and the top plate which is connected to the nose by a fastening device.
Figure 2:
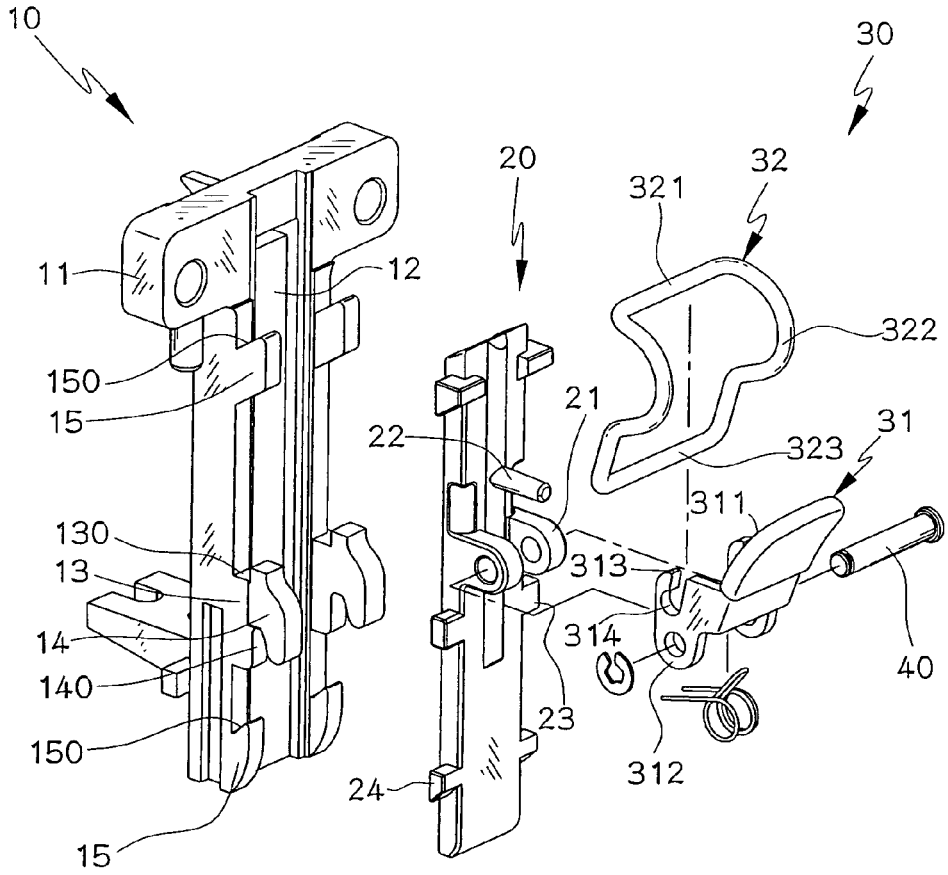
FIG. 2 is an exploded view to show the nose, the top plate and the fastening device in FIG. 1.

Referring to FIGS. 1 and 2, the present invention relates to an assembly of a stapler nose 10 and a top plate 20 of a stapler wherein the nose 10 is fixed to the stapler at the fixing head 11 and includes a passage 12 defined therein so that the staples (not shown) are engaged therewith. Two pairs of first stops 15 and one pair of second stops 13 extend from the two sides of the nose 10, wherein the second stops 13 are located between the two pairs of first stops 15. Two hooks 14 are connected to two respective tops of the pair of second stops 13 and each hook 14 has an engaging recess 140. Each hook 14 includes an extended portion which extends beyond an end of the second stop 13 corresponding thereto so as to from a notch 130. The top plate 20 includes three pairs of positioning blocks 23, 24 on the two sides thereof so that the three pairs of positioning blocks 23, 24 are engaged with the two pairs of first stops 15 and the one pair of second stops 13, wherein the positioning blocks 23 are engaged with the notches 130. It is noted that the two pairs of first stops 15 each have an inclined side so as to define a notch 150 with which respective one of the two positioning blocks 24 is engaged, and the notches 150 of the two pairs of first stops 15 open to a direction opposite to a direction that the engaging recess 140 opens to. The top plate 20 has two first lugs 21 extending from a face of two sides thereof.

A fastening device 30 includes a pivotable member 31 which includes two second lugs 312 and each second lug 312 has a connection end 313 which includes a notch 314. The two second lugs 312 are pivotably connected between the two first lugs 21 by a pin 40 and the pivotable member 31 includes a pull portion 311 to which a user may pivot the pivotable member 31. An enclosed loop 32 has a first straight section 321 for being engaged with the notches 314 in the two second lugs 312 and a rear straight section 323 for being engaged with the first engaging recesses 140 of the hooks 14. Two curve sections 322 are connected between the first straight section 321 and the second straight section 323. The top plate 20 has a rod 22 extending from the face thereof and a distal end of the rod 22 is in contact with an underside of the pivotable member 31 to restrict the pivotable member 31 from being over pivoted.

The enclosed loop 32 bears the stress and spreads the stress to the whole loop 32 so that the enclosed loop 32 is stronger than the conventional U-shaped member.

Figure 3:
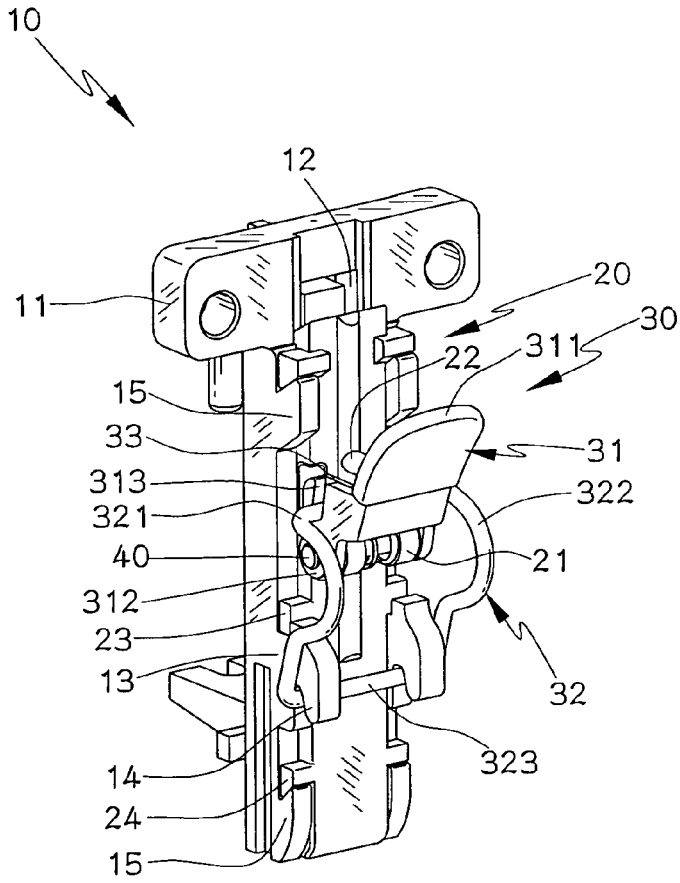
FIG. 3 is a perspective view to show another embodiment of the assembly of the nose and the top plate which is connected to the nose by a fastening device.
Figure 4:
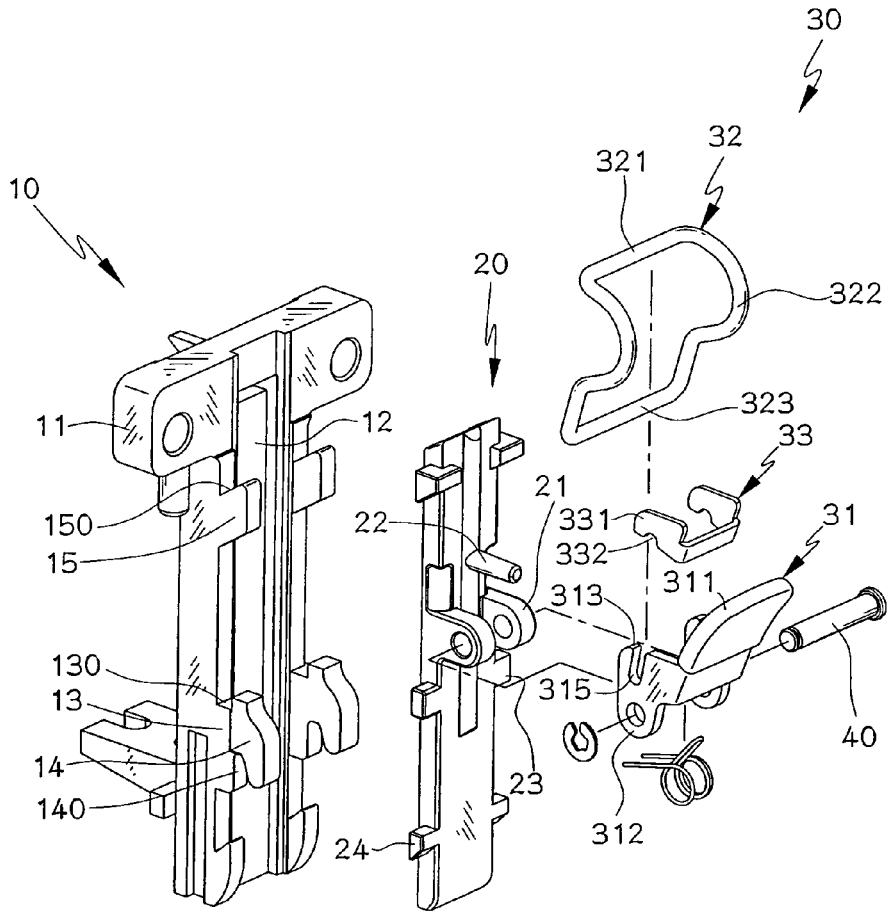
FIG. 4 is an exploded view to show the nose, the top plate and the fastening device in FIG. 3.

FIGS. 3 and 4 show another embodiment, wherein the connection ends 313 of the second lugs 312 includes a slot 315 with a consistent width and the connection ends 313 are cooperated with a positioning member 33 to position the first straight section 321 of the enclosed loop 32. The positioning member 33 is located between the two second lugs 312 of the pivotable member 31 and includes two extensions 331. Each of the two extensions 331 has a concavity 332 with which the first straight section 321 of the enclosed loop 32 is engaged.

While we have shown and described the embodiment in accordance with the present invention, it should be clear to those skilled in the art that further embodiments may be made without departing from the scope of the present invention.

What is claimed is:

1. A assembly of a stapler nose (10) and a top plate (20), wherein the nose (10) includes a passage (12) defined therein and two hooks (14) extend from two sides of a face of the nose (10), each hook (14) has an engaging recess (140), the top plate (20) has two first lugs (21) extending from a face of two sides thereof and mounted on the face of the nose (10), and a fastening device (30) includes a pivotable member (31) which includes two second lugs (312) and each second lug (312) has a notch (314), the two second lugs (312) are pivotably connected between the two first lugs (21), an enclosed loop (32) has a first straight section (321) for being engaged with the notches (314) in the two second lugs (312) and a rear straight section (323) for being engaged with the first engaging recesses (140) of the hooks (14).

2. The assembly as claimed in claim 1, wherein the nose (10) includes two pairs of first stops (15) and one pair of second stops (13) extending from the two sides thereof, the top plate (20) includes three pairs of positioning blocks (23, 24) on the two sides thereof so that the three pairs of positioning blocks (23, 24) are engaged with the two pairs of first stops (15) and the one pair of second stops (13).

3. The assembly as claimed in claim 2, wherein the two hooks (14) are connected to two respective tops of the pair of second stops (13), each hook (14) includes an extended portion which extends beyond an end of the second stop (13) corresponding thereto so as to from a notch (130) with which the positioning blocks (23) are engaged.

4. The assembly as claimed in claim 2, wherein the two pairs of first stops (15) each have an inclined side so as to define a notch (150) with which respective one of the two positioning blocks (24) is engaged.

5. The assembly as claimed in claim 4, wherein the notches (150) of the two pairs of first stops (15) open to a direction opposite to a direction that the engaging recess (140) opens to.

6. The assembly as claimed in claim 1, wherein the enclosed loop (32) includes two curve sections (322) which are connected between the first straight section (321) and the second straight section (323).

7. The assembly as claimed in claim 1, wherein a positioning member (33) is located between the two second lugs (312) of the pivotable member (31) and includes two extensions (331), each of the two extensions (331) has a concavity (332) with which the first straight section (321) of the enclosed loop (32) is engaged.

8. The assembly as claimed in claim 1, wherein the top plate (20) has a rod (22) extending from the face thereof and a distal end of the rod (22) is in contact with an underside of the pivotable member (31) to restrict the pivotable member (31) from being over pivoted.

* * * * *